US010551108B2

(12) United States Patent
Bagwell, Sr.

(10) Patent No.: US 10,551,108 B2
(45) Date of Patent: Feb. 4, 2020

(54) SYSTEM AND DEVICE FOR COOLING BEVERAGES AND KEEPING BEVERAGES COLD

(71) Applicant: Bagwell Entertainment LLC, Knoxville, TN (US)

(72) Inventor: Ross K. Bagwell, Sr., Knoxville, TN (US)

(73) Assignee: Bagwell Entertainment LLC, Knoxville, TN (US)

( * ) Notice: Subject to any disclaimer, the term of this patent is extended or adjusted under 35 U.S.C. 154(b) by 464 days.

(21) Appl. No.: 15/158,772

(22) Filed: May 19, 2016

(65) Prior Publication Data

US 2016/0341464 A1 Nov. 24, 2016

Related U.S. Application Data

(60) Provisional application No. 62/163,732, filed on May 19, 2015.

(51) Int. Cl.
*F25D 3/08* (2006.01)
*B65D 25/04* (2006.01)
*B65D 25/28* (2006.01)

(52) U.S. Cl.
CPC ..... *F25D 3/08* (2013.01); *F25D 2303/0831* (2013.01); *F25D 2303/0843* (2013.01); *F25D 2331/803* (2013.01); *F25D 2331/805* (2013.01)

(58) Field of Classification Search
CPC ..... F25D 3/08; F25D 2303/0831; F25D 2303/0843; F25D 2331/803; F25D 2331/805; F25D 2303/0832; F25D 5/02; F25D 2331/801; B65D 81/3895; B65D 75/5883; B65D 81/3272; B65D 81/3484
See application file for complete search history.

(56) References Cited

U.S. PATENT DOCUMENTS 2,575,191 A * 11/1951 Seipp ..... B65D 31/04 383/97
2,667,198 A * 1/1954 Klein ..... A45C 11/20 383/97

(Continued)

*Primary Examiner* — Frantz F Jules
*Assistant Examiner* — Martha Tadesse
(74) *Attorney, Agent, or Firm* — Dickinson Wright PLLC

(57) ABSTRACT

Systems and devices cool content of individual beverage containers without sacrificing portability and cooling performance, and/or maintaining beverage containers cold. Exemplary implementations provide container having enclosed vertical double-wall structure with integral horizontal base defining interior space within enclosed vertical double-wall structure, or having wall structure formed from sheet of flexible material folded to form base and sealed along opposite sides of sheet to define interior space within wall structure and also having interior pocket formed by interior wall attached to interior surface wall structure. Interior space within wall structure is capable of accommodating at least one beverage container. Cooling material is sealed inside the double-wall structure, or removably placed inside interior pocket, to cool and/or maintain cold content of beverage container placed in interior space of container. Method includes providing container including wall structure accommodating cooling material and removably placing cooling material said structure.

9 Claims, 14 Drawing Sheets

SIDE

(56) References Cited

U.S. PATENT DOCUMENTS 3,087,667 A * 4/1963 Nugey ..... B65D 5/46128 229/117.14
3,228,584 A * 1/1966 Ashton ..... B65D 33/28 383/203
3,339,824 A * 9/1967 Luke ..... B65D 31/12 383/25
3,614,875 A * 10/1971 McCallun ..... F25D 3/00 383/38
4,620,633 A * 11/1986 Lookholder ..... B29C 44/185 206/523
4,723,974 A * 2/1988 Ammerman ..... A01N 1/02 62/371
4,759,642 A * 7/1988 Van Erden ..... B65D 31/00 229/117.35
4,809,352 A * 2/1989 Walker ..... A45C 3/00 206/522
4,925,438 A * 5/1990 Wagner ..... B65D 31/10 493/194
6,474,095 B1 * 11/2002 Chan ..... B65D 81/3893 62/457.2
7,040,115 B1 * 5/2006 Lopez ..... F25D 3/08 62/371
8,209,995 B2 * 7/2012 Kieling ..... A45C 3/001 62/457.1
8,424,335 B2 * 4/2013 Corder ..... A61J 1/165 229/103
8,763,811 B2 * 7/2014 Lantz ..... B65D 25/16 206/584
9,205,962 B2 * 12/2015 Holderby ..... B65D 51/245
9,376,605 B2 * 6/2016 Matta ..... B29C 44/14
2003/0000517 A1 * 1/2003 Joseph ..... B65D 81/3484 126/263.06
2007/0157657 A1 * 7/2007 Fogerty ..... A45C 11/20 62/457.2
2007/0193297 A1 * 8/2007 Wilson ..... F25D 29/00 62/371
2007/0204645 A1 * 9/2007 Balva ..... F25D 3/08 62/371
2008/0127668 A1 * 6/2008 DeVito ..... F25D 3/08 62/371
2009/0034883 A1 * 2/2009 Giuliani ..... B65D 33/1683 383/6
2011/0259894 A1 * 10/2011 Cheung ..... A45C 11/20 220/592.01
2012/0243808 A1 * 9/2012 de Lesseux ..... B65D 81/3897 383/110
2013/0174600 A1 * 7/2013 Sarcinella ..... B65D 75/5883 62/457.9
2014/0093188 A1 * 4/2014 Bush ..... A45C 3/04 383/6
2015/0068242 A1 * 3/2015 Patstone ..... F25D 3/08 62/457.2
2018/0319569 A1 * 11/2018 McGoff ..... B65D 81/3897

* cited by examiner

FRONT / BACK

SIDE

TOP

SYSTEM AND DEVICE FOR COOLING BEVERAGES AND KEEPING BEVERAGES COLD

This application claims benefit under 35 U.S.C. § 119(e) from U.S. Provisional Patent Application Ser. No. 62/163,732 filed on May 19, 2015, the entire content of which is incorporated herein by reference.

BACKGROUND OF THE INVENTION

1. Field of Invention

The present invention relates to systems and devices that provide potable cooling and storage for beverages in individual containers such as cans or bottles.

2. Description of Related Art

Conventional beverage containers, such as portable coolers that can cool beverages without an electric refrigeration system, are typically made of heavy insulating material and designed to handle larger quantities of beverage containers, for example at least a package of six cans or bottles, as well as cooling elements such as simple ice, or a sachet(s) containing a gel that can be frozen. On the other hand, conventional individualized cooling devices that have gained popularity are can or bottle holders made of wet suit material that do not cool the content of the beverage container but simply provide added insulation for the content.

SUMMARY OF THE INVENTION

Exemplary embodiments of the present invention provide a portable cooling system including a rigid container having an enclosed vertical double-wall structure with an integral horizontal base defining an interior space within the enclosed vertical double-wall structure for accommodating a beverage container. Cooling material is removably placed inside the double-wall structure to cool and/or maintain cold content of the beverage container placed in the interior space.

According to an exemplary implementation of embodiments of the present invention, a removable lid inclosing a double-wall structure can be provided to selectively retain the cooling material inside the double-wall structure.

According to another exemplary implementation of embodiments of the present invention, cooling material comprises a free-flowing liquid, or a sachet containing a freezable gel.

According to yet another exemplary implementation of embodiments of the present invention, interior space within the enclosed vertical double-wall structure is partitioned into two subspaces, each of the two subspaces configured to accommodate a beverage container.

Other exemplary embodiments of the present invention provide a container having an enclosed vertical double-wall structure with an integral horizontal base defining an interior space within the enclosed vertical double-wall structure for accommodating at least one beverage container. Cooling material is sealed inside the double-wall structure of the container to cool and/or maintain cold a content of the beverage container placed in the interior space.

According to an exemplary implementation of embodiments of the present invention, an integral closure is disposed on an end of the wall structure distal from the base.

According to another exemplary implementation of embodiments of the present invention, integral closure includes a handle structure with an opening to facilitate hand carry of the container.

According to yet another exemplary implementation of embodiments of the present invention, integral closure further include a re-sealable component to retain the handle structure in a closed position.

Yet other exemplary embodiments of the present invention provide a portable cooling container comprising an exterior wall structure formed from a single sheet of flexible material folded to form a base and sealed along opposite sides of the sheet to define an interior space within the wall structure for accommodating one or more beverage containers in the interior space. At least one interior pocket is formed by an interior wall attached to a portion of an interior surface of the wall structure.

Still further exemplary embodiments of the present invention provide a portable cooling system comprising a container including an exterior wall structure formed from a single sheet of flexible material folded to form a base and sealed along opposite sides of the sheet to define an interior space within the wall structure for accommodating one or more beverage containers in the interior space. An interior pocket is formed by the interior wall attached to a first portion of an interior surface of the wall structure. A cooling material is removably placed inside at least one interior pocket to cool and/or maintain cold a content of the one or more beverage containers placed in the interior space.

According to an exemplary implementation of embodiments of the present invention, a second interior pocket is formed by a second interior wall attached to a second portion of the interior surface of the wall structure.

According to another exemplary implementation of embodiments of the present invention, a second portion of the interior surface of the wall structure is opposite the first portion of the interior surface of the wall structure.

Still further exemplary embodiments of the present invention provide method comprising providing a container including an exterior wall structure formed from a single sheet of flexible material folded to form a base and sealed along opposite sides of the sheet to define an interior space within the wall structure for accommodating one or more beverage containers in the interior space, and an interior pocket formed by a interior wall attached to a portion of an interior surface of the wall structure. The method includes removably placing a cooling material inside the at least one interior pocket to cool and/or maintain cold a content of the one or more beverage containers placed in the interior space.

BRIEF DESCRIPTION OF THE DRAWINGS

The various objects, advantages and novel features of the present invention will be best understood by reference to the detailed description of the preferred embodiments which follows, when read in conjunction with the accompanying drawings in which the same reference numerals will be understood to refer to the same elements, features, and structures, where:

FIGS. 18, 19, and 20 illustrate yet another exemplary implementation of a device for cooling beverages and keeping beverages cold according to another exemplary embodiment of the present invention;

FIGS. 21 and 22 illustrate yet another exemplary implementation of a device for cooling beverages and keeping beverages cold according to another exemplary embodiment of the present invention.

DESCRIPTION OF EXEMPLARY EMBODIMENTS

Figure 1:
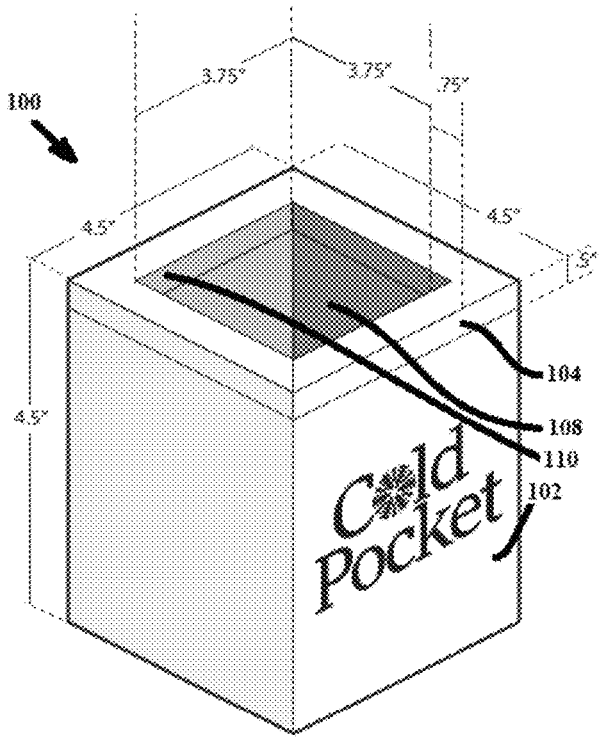
FIGS. 1, 2, 3, 4, 5, 6, 7, and 8 illustrate an exemplary implementation of a device and a system for cooling beverages and keeping beverages cold according to an exemplary embodiment of the present invention.
Figure 2:
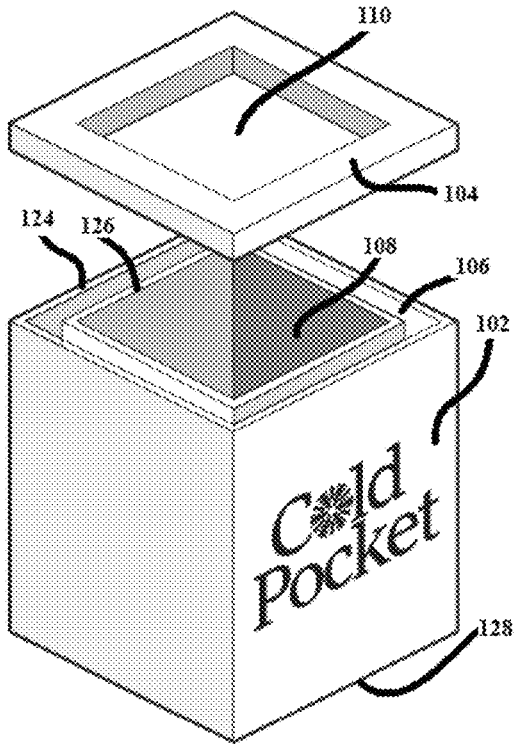
Figure 3:
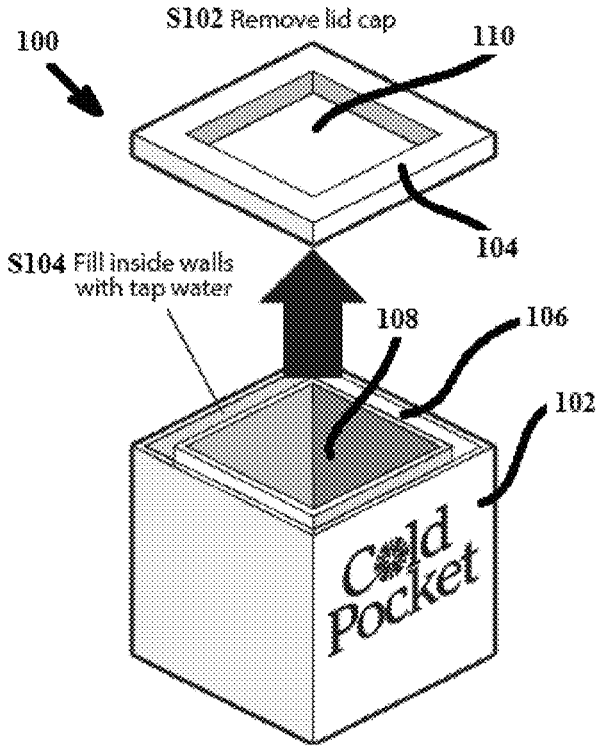

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Exemplary embodiments of the present invention will now be described in detail with reference to the annexed drawings. In the following description, a detailed description of known functions and configurations incorporated herein has been omitted for clarity and conciseness. Specific dimensions of various components provided in the drawings are to facilitate understanding of exemplary embodiment s of the present invention.

Exemplary embodiments of the present invention provide systems and devices that can cool content of individual beverage containers without sacrificing portability and cooling performance.

Referring to FIGS. 1-8, an exemplary embodiment of the present invention provides a system 100 including a rigid container 102 having an enclosed vertical double-wall structure 124, 126 with an integral horizontal base 128 defining an interior space 108 within the enclosed vertical double-wall structure 124, 126 for accommodating a beverage container 130. The system 100 also includes cooling material 106, which can be a free-flowing liquid such as water, placed S104 inside the double-wall structure 124, 126 to cool and/or maintain cold S114 the content of the beverage container 130 placed S112 in the interior space 108.

Figure 4:
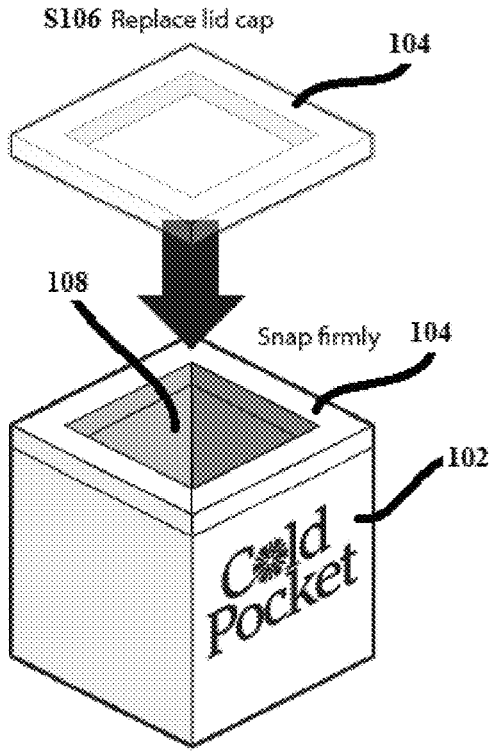
Figure 5:
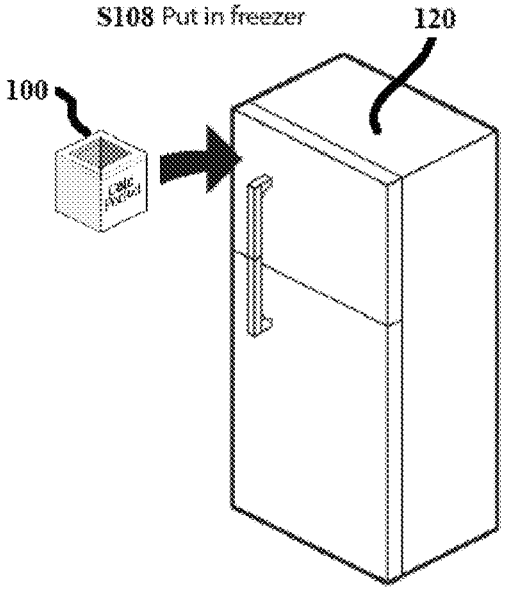
Figure 6:
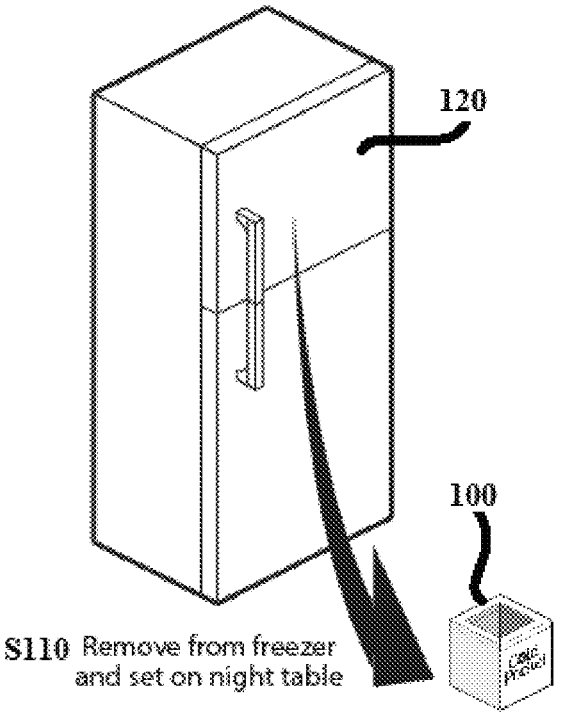
Figure 7:
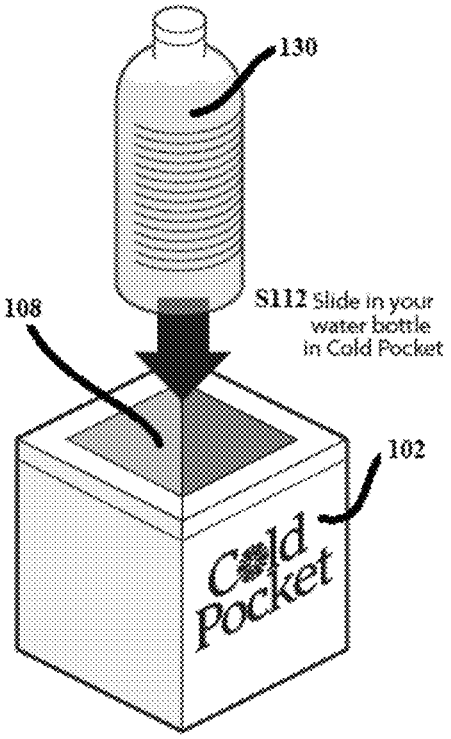
Figure 8:
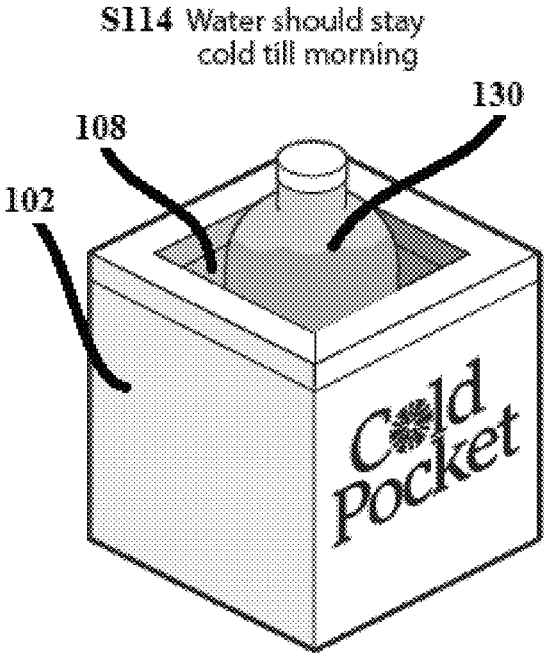
Figure 9:
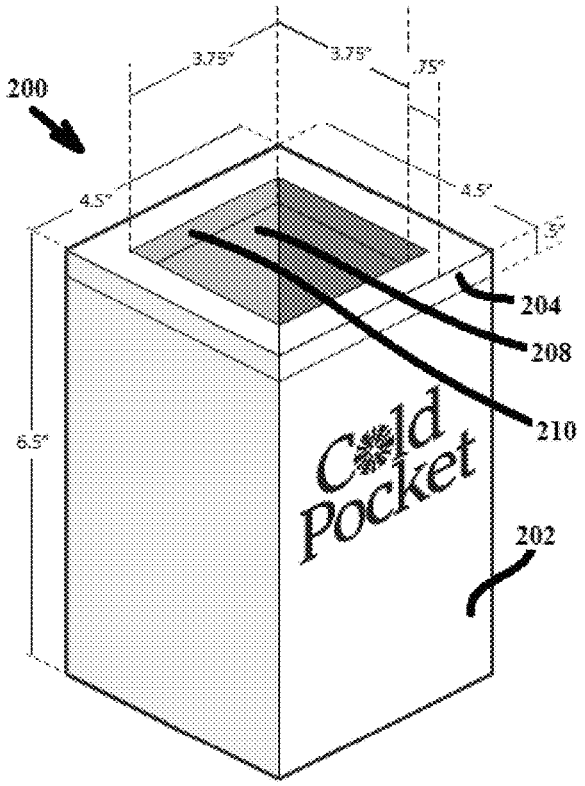
FIGS. 9, 10, 11, 12, 13, 14, 15, 16, and 17 illustrate another exemplary implementation of a device and a system for cooling beverages and keeping beverages cold according to an exemplary embodiment of the present invention.

In an exemplary implementation, the cooling material can be liquid, such as water, frozen prior to use of the container 102, in which case the system can further comprise a removable S102 lid 104 inclosing S106 the double-wall structure 124, 126 to prevent liquid 106 from spilling during a freezing and/or cooling process, for example when placed into S108 or removed from S110 a conventional freezer 120. In a further exemplary implementation, the shape of lid 104 mirrors the cross-sectional shape of the double-wall structure 124, 126, and includes an opening 110 allowing beverage container to pass therethrough when lid 104 is snap fit S106 onto the double-wall structure 124, 126, as illustrated in FIGS. 4 and 7.

Referring to FIGS. 9-17, another exemplary embodiment of the present invention provides a system 200 including a rigid container 202 having an enclosed vertical double-wall structure 224, 226 with an integral horizontal base 228 defining an interior space 208 within the enclosed vertical double-wall structure 224, 226 for accommodating a beverage container 130. The system 200 also includes cooling material 218 that can be placed S204 inside the double-wall structure 224, 226 to cool and/or maintain cold S210 the content of the beverage container 130 placed S208 in the interior space 208.

In another exemplary implementation, the vertical double-wall structure 224, 226 includes vertical partitions 214 subdividing the double-wall structure 224, 226 into compartments 216. Each compartment 216 can accommodate therein cooling material 218, which can be a sachet containing a gel that can be frozen, placed S104 inside the double-wall structure 224, 226 to cool the content of the beverage container 130 placed S208 in the interior space 208.

Figure 10:
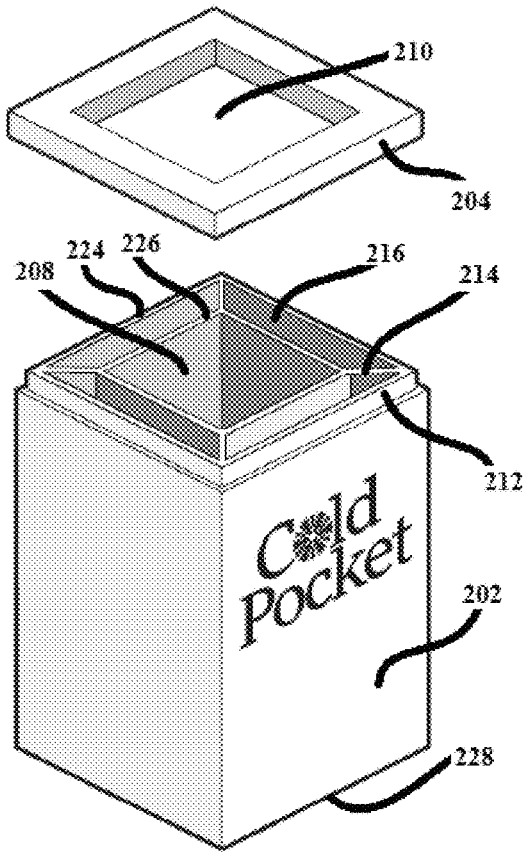
Figure 11:
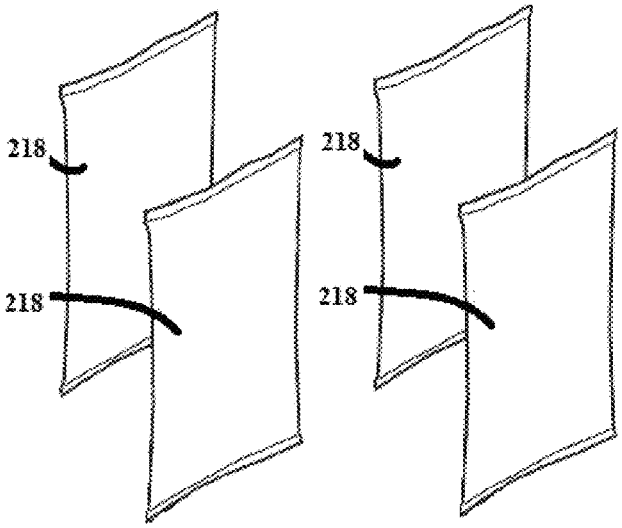
Figure 12:
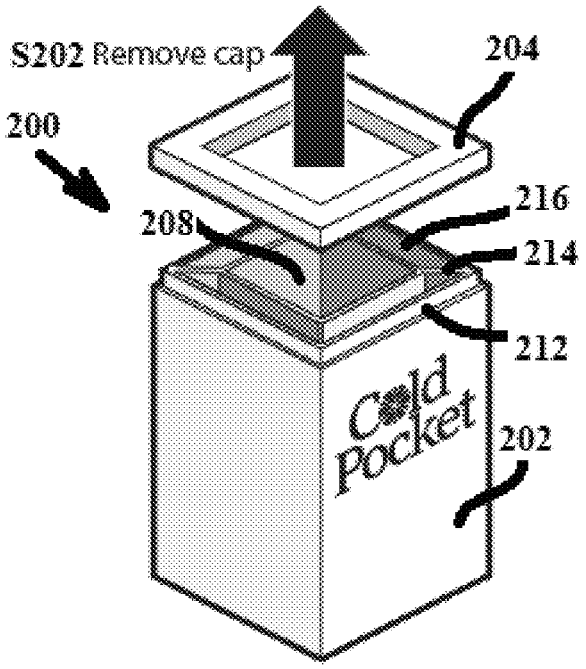
Figure 13:
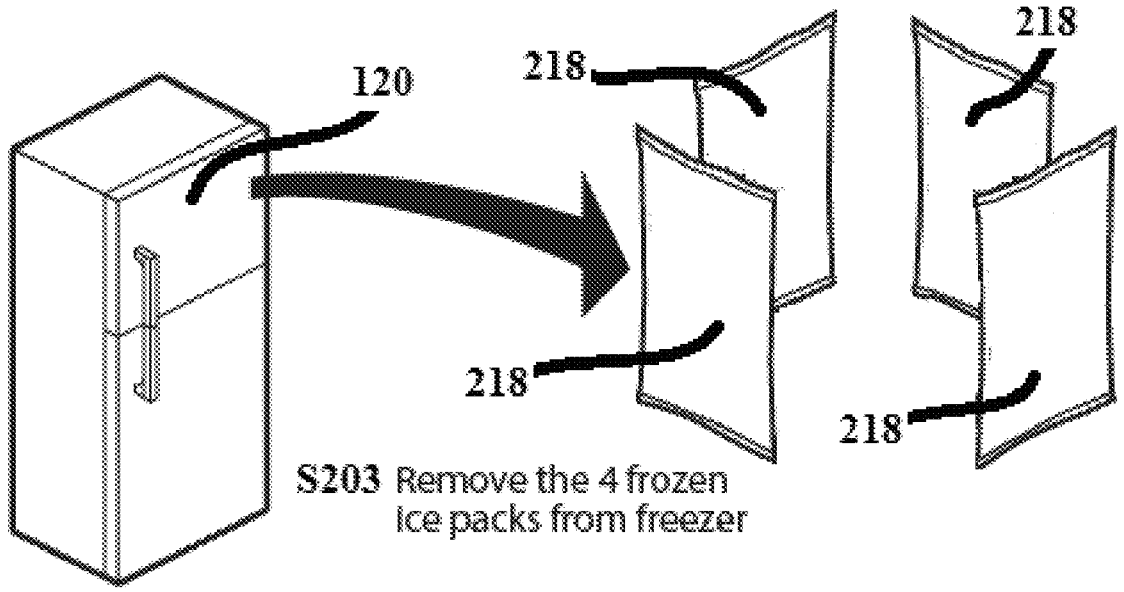
Figure 14:
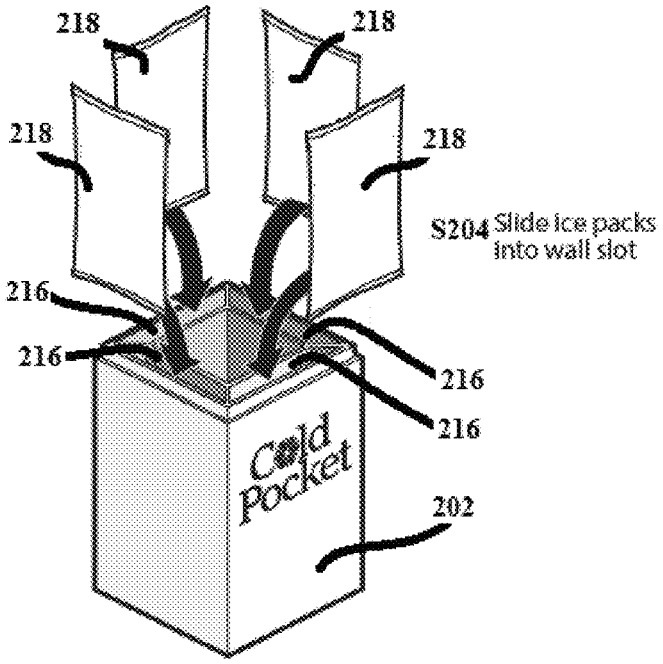
Figure 15:
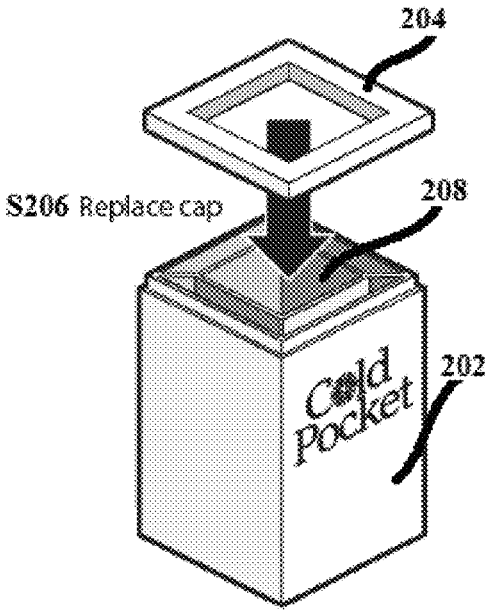
Figure 16:
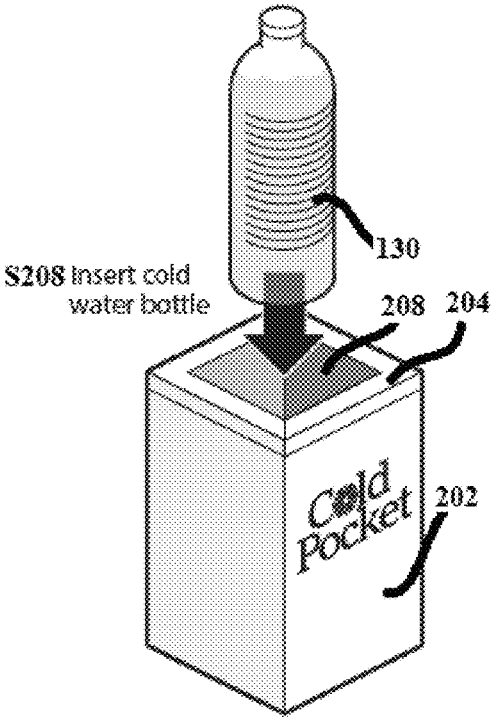
Figure 17:
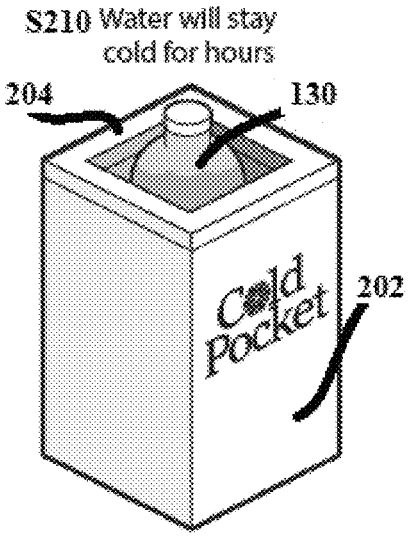

In an exemplary implementation, system 200 can further comprise a removable S202 lid or cap 204 inclosing S206 the double-wall structure 124, 126 to securely retain cooling material 218 placed in at least one of the compartments 216, for example after the cooling material has been frozen in, and removed S203 from, a conventional freezer 120. In a further exemplary implementation, the shape of lid 204 mirrors the cross-sectional shape of the double-wall structure 224, 226, and includes an opening 210 allowing beverage container 130 to pass therethrough when lid 204 is snap fit S206 onto the double-wall structure 224, 226, as illustrated in FIGS. 14 and 15. In yet another exemplary implementation, double-wall structure 224, 226 includes an exterior step 212 which fits into lid 204 to facilitate the snap fitting S206 of lid 204 onto the double-wall structure 224, 226, as illustrated in FIGS. 10, 15 and 16.

Figure 18:
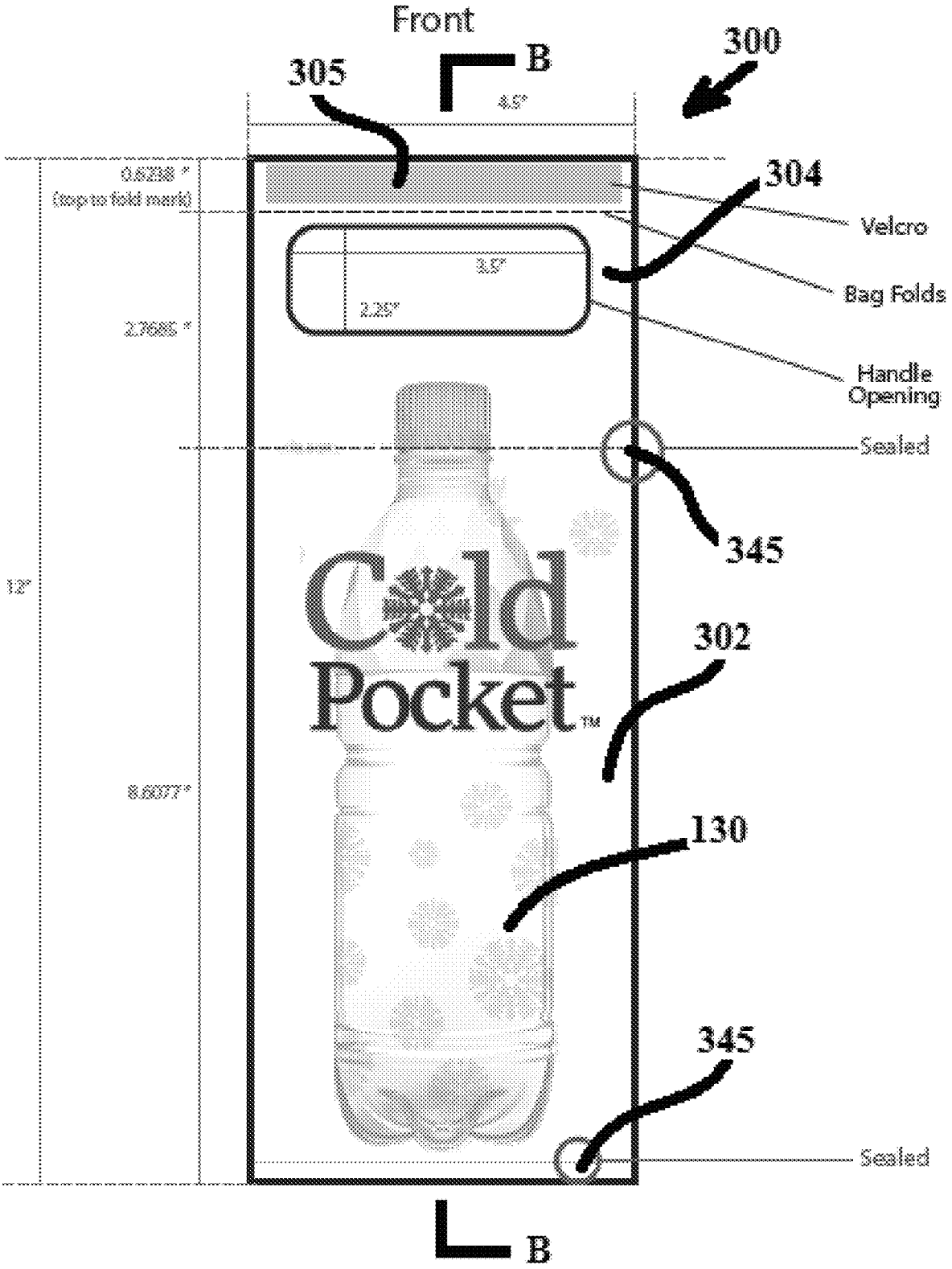
FIGS. 18, 19, and 20 illustrate yet another exemplary implementation of a device for cooling beverages and keeping beverages cold according to an exemplary embodiment of the present invention.
Figure 19:
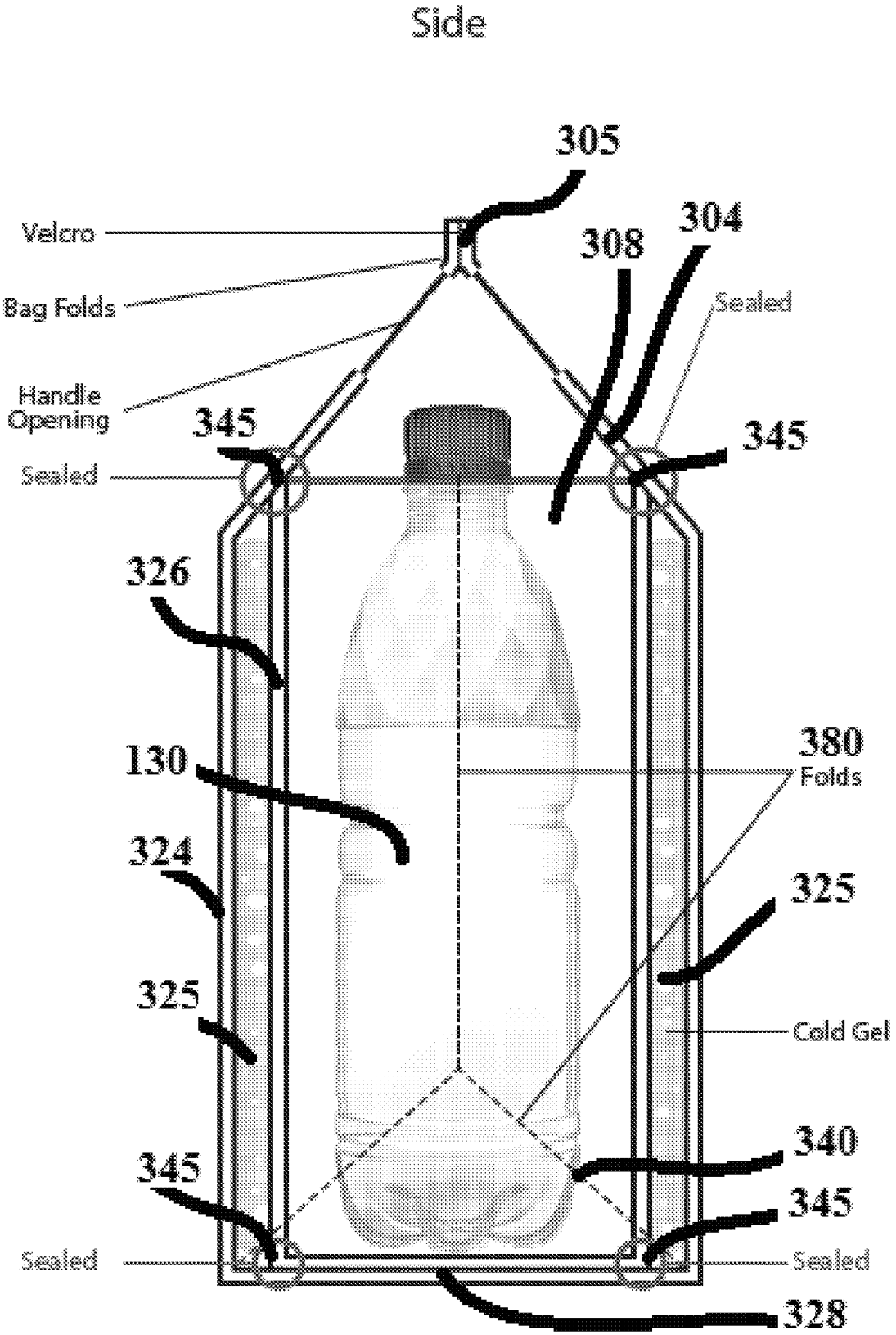
Figure 20:
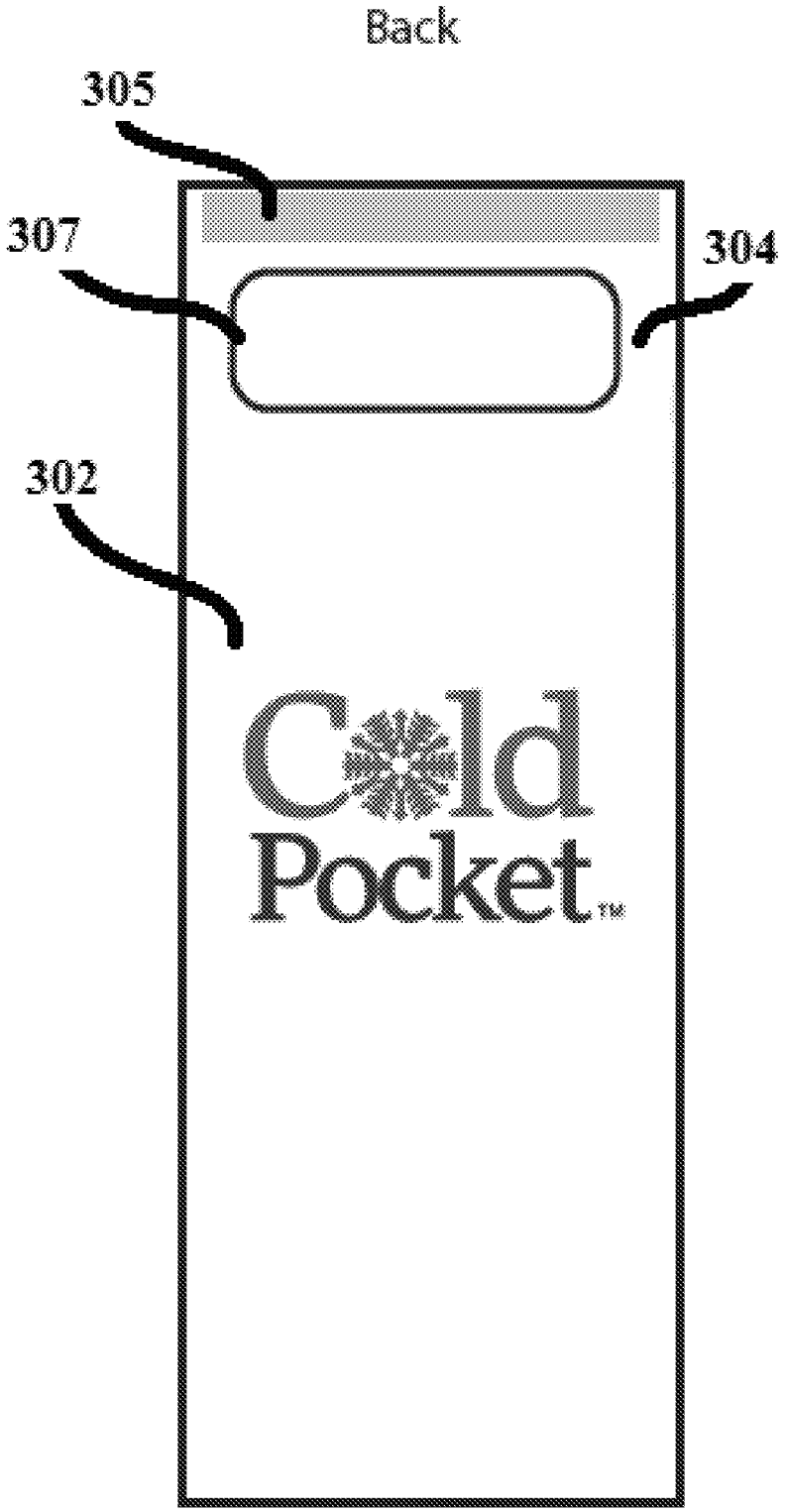

Referring to FIGS. 18-20, yet another exemplary embodiment of the present invention provides a system 300 including a container 302 having an enclosed vertical double-wall structure 324, 326 with an integral horizontal base 328 defining an interior space 308 within the enclosed vertical double-wall structure 324, 326 for accommodating a beverage container 130. System 300 also includes cooling material 325, such as cold gel, sealed 345 inside the double-wall structure 324, 326 of contained 302 to cool and/or maintain cold the content of the beverage container 130 placed in the interior space 308.

In an exemplary implementation, container 302 can further comprise an integral closure 304 disposed, for example starting at seal 345 on end of wall structure 324, 326 distal from the base 328. Closure 304 can be selectively opened to receive beverage container 130 into space 308, and closed to securely retain beverage container 130 placed within interior space 308. In another exemplary implementation, the shape of closure 304 can include a handle structure including an opening 307 to facilitate hand carry of container 302. In yet another exemplary implementation, closure 304 can include a re-sealable component 305, such as Velcro material, to help retain handle structures in a closed position, as illustrated in a cross-sectional view of FIG. 19. In yet further exemplary embodiment of the present invention container 302 is formed from a resilient material including folds 380 to facilitate portability of container 302 when not accommodating beverage container 130 by collapsing of interior space 308 such that container 302 folds essentially flat when not in use, or when placed in a conventional freezer to cool and/or freeze cooling material 325.

Figure 21:
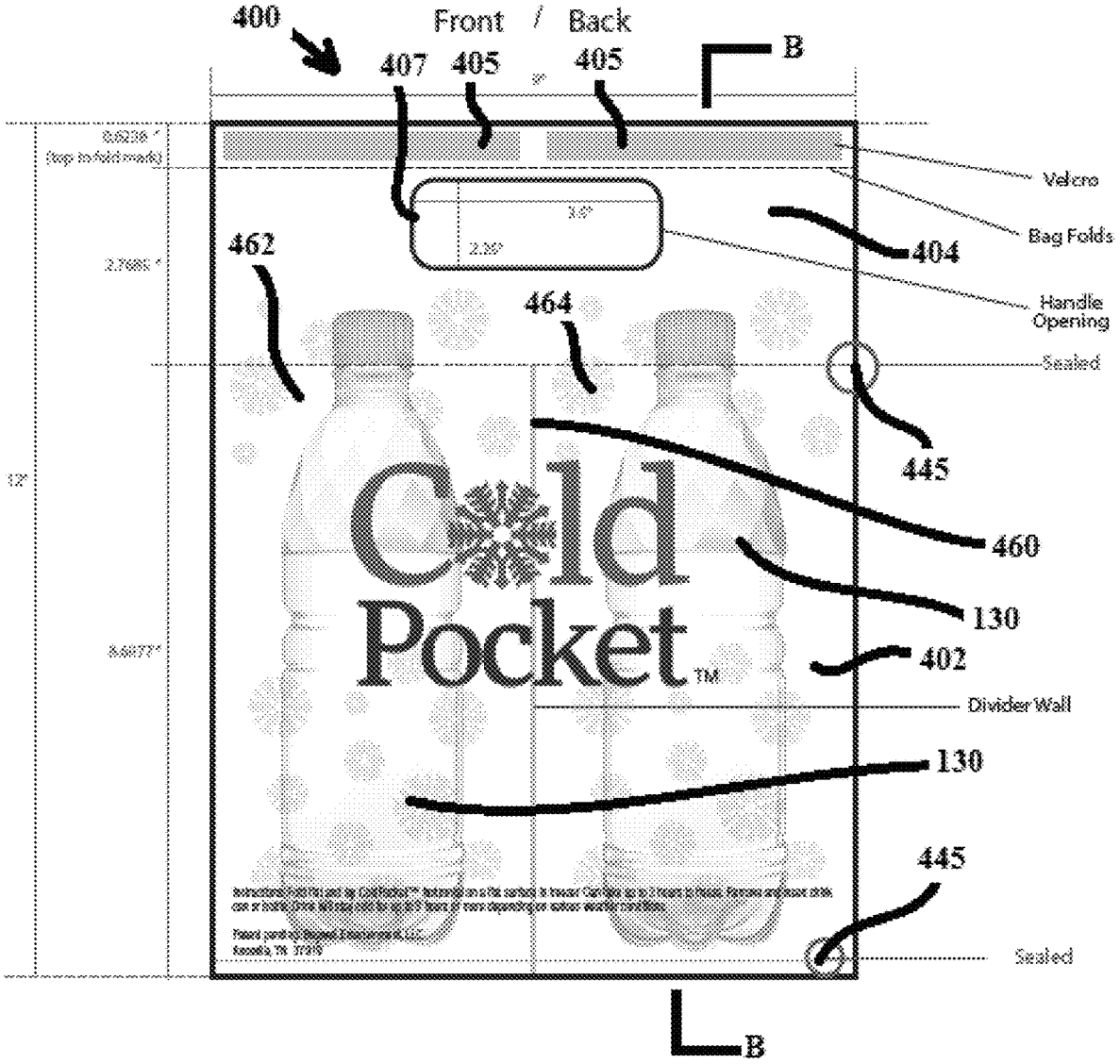
FIGS. 21 and 22 illustrate still yet another exemplary implementation of a device for cooling beverages and keeping beverages cold according to an exemplary embodiment of the present invention.
Figure 22:
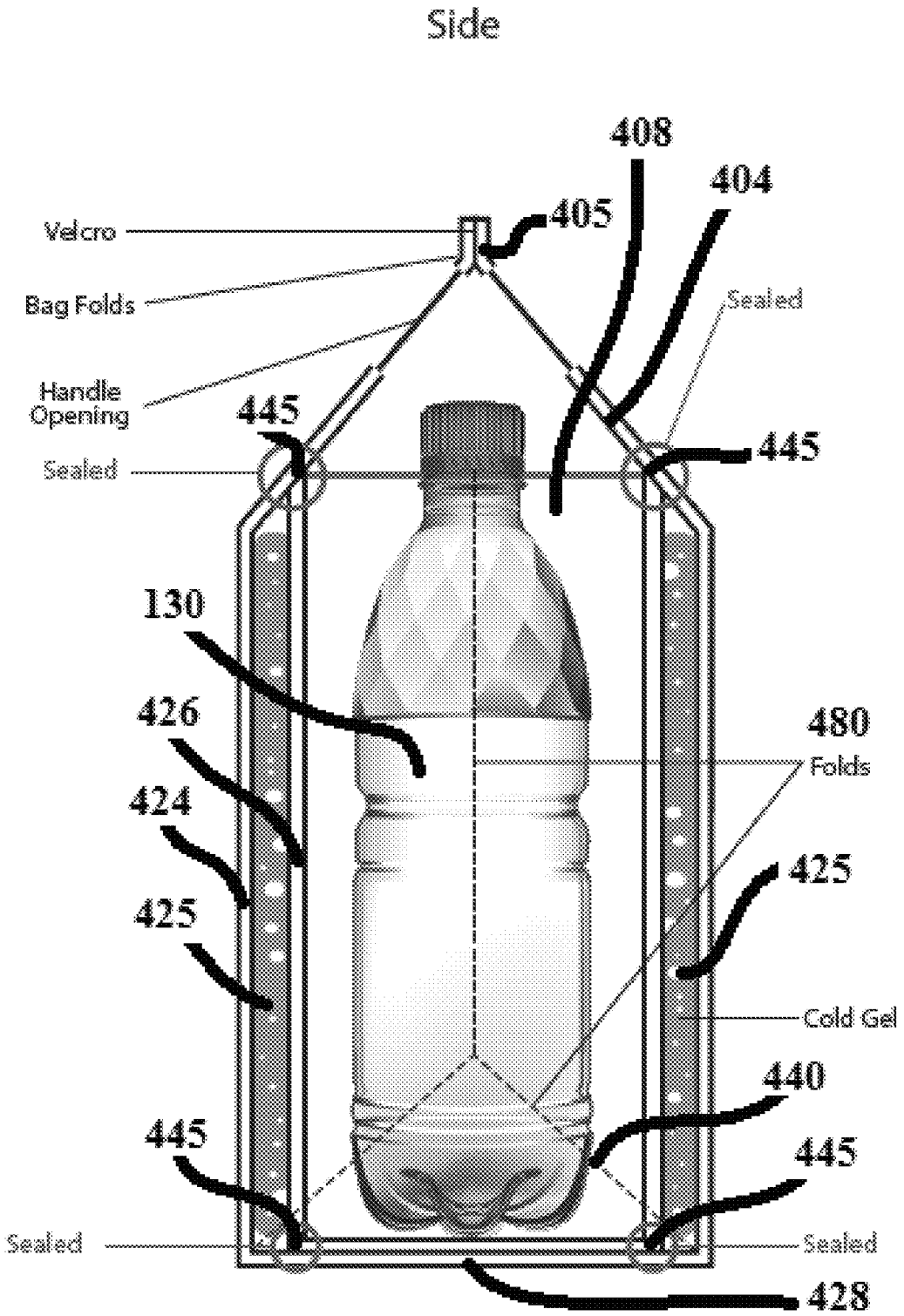

Referring to FIGS. 21 and 22, yet another an exemplary embodiment of the present invention provides a system 400 including a container 402 having an enclosed vertical double-wall structure 424, 426 with an integral horizontal base 428 defining an interior space 408 within the enclosed vertical double-wall structure 424, 426 for accommodating two beverage containers 130. Similar to system 300, system 400 also includes cooling material 425, such as cold gel, sealed 445 inside the double-wall structure 424, 426 of contained 402 to cool and/or maintain cold the content of the beverage container s130 placed in the interior space 408. In an exemplary implementation, interior space 408 is subdivided into two interior sub-spaces 462, 464, for example a longitudinal seal 460 extending from base 428 along vertical double-wall structure 424, 426.

In an exemplary implementation, container 402 can further comprise an integral closure 404 disposed, for example starting at seal 445 on end of wall structure 424, 426 distal from the base 428. Closure 404 can be selectively opened to receive beverage containers 130 into respective sub-spaces 462, 464 of interior space 408, and closed to securely retain beverage containers 130 placed within interior space 408. In another exemplary implementation, the shape of closure 404 can include a handle structure including an opening 407 to facilitate hand carry of container 402. In yet another exemplary implementation, closure 404 can include one or more re-sealable components 405, such as Velcro material, to help retain handle structures in a closed position, as illustrated in a cross-sectional view of FIG. 22. In yet further exemplary embodiment of the present invention container 402 is formed from a resilient material including folds 480 to facilitate portability of container 402 when not accommodating beverage containers 130 by collapsing of interior space 408 such that container 402 folds essentially flat when not in use, or when placed in a conventional freezer to cool and/or freeze cooling material 425.

Figure 23:
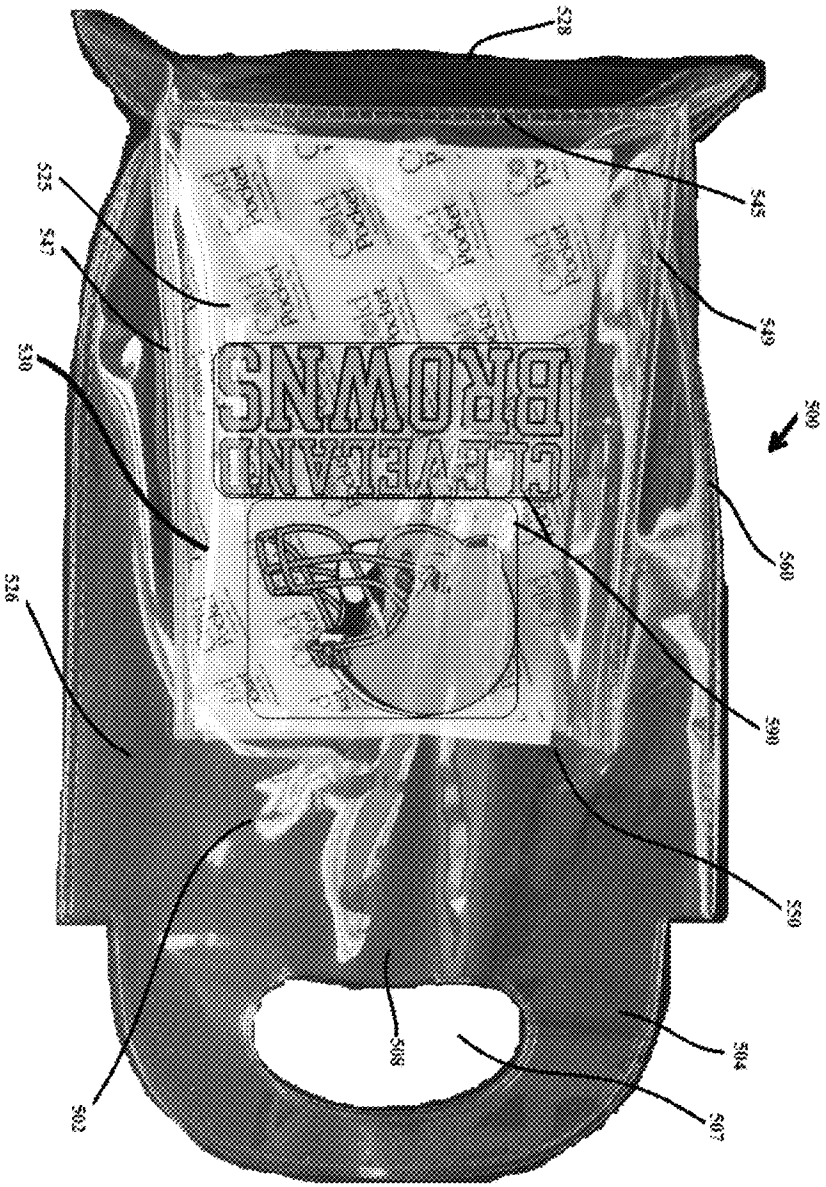
FIGS. 23, 24, and 25 illustrate yet another exemplary implementation of a device for cooling beverages and keeping beverages cold according to another exemplary embodiment of the present invention
Figure 24:
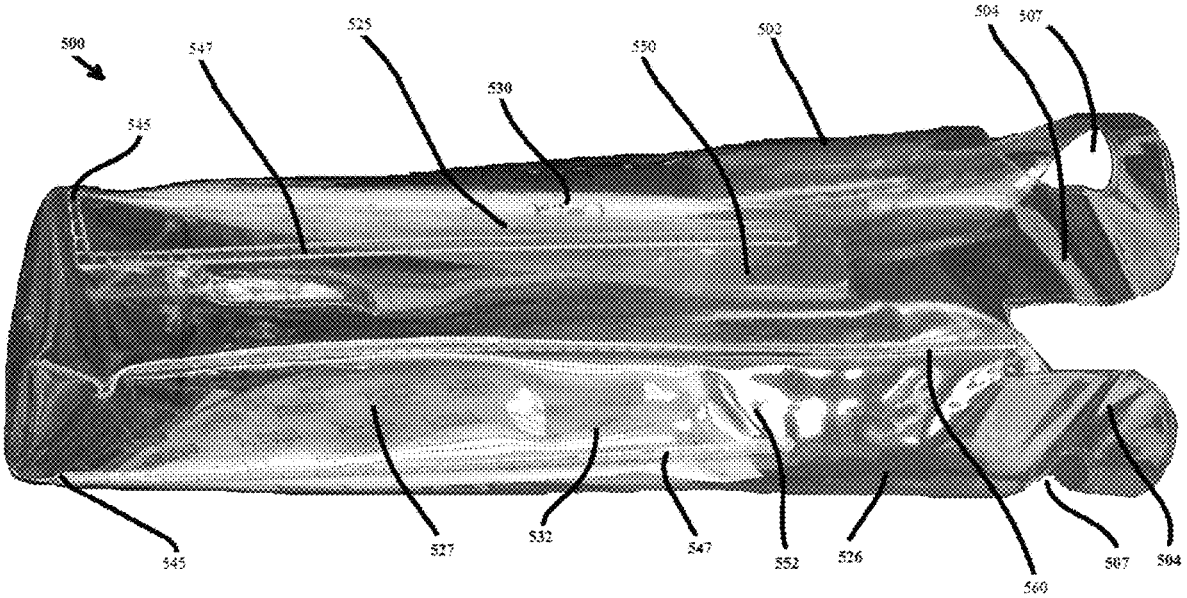
Figure 25:
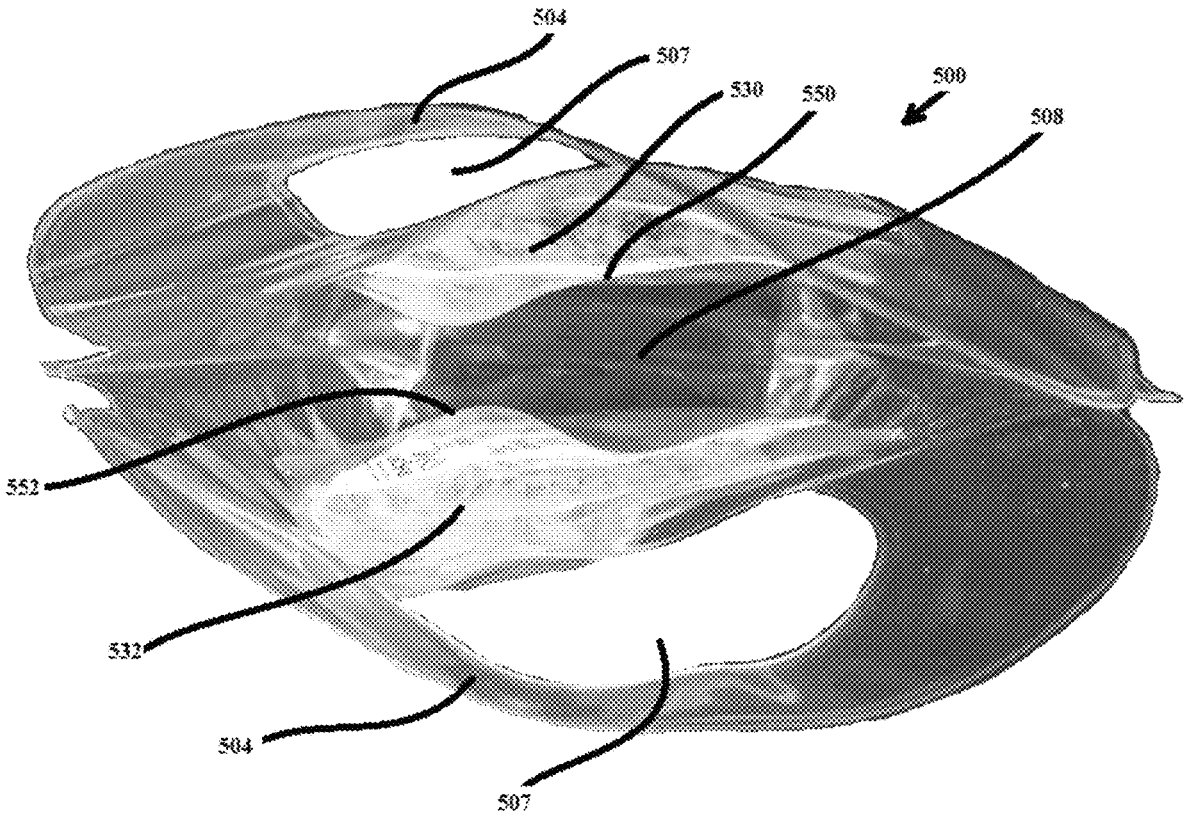

FIGS. 23-25 illustrate front/back, side and top views, respectively of yet another exemplary embodiment of the present invention which provides a system 500 including a container 502 formed of flexible material, which can be transparent. In an exemplary implementation, container 502 has an exterior wall structure 526, which can be formed from a single sheet of flexible plastic material folded to form base 528 and sealed along opposite sides 560, 562 defining an interior space 508 within the wall structure 526 for accommodating one or more beverage containers, such as container 130, therein. Container 502 further includes interior pockets 530, 532, which in an exemplary implementation are formed by interior walls 550, 552 attached to interior surface of wall structure 526 by seals 545, 547, 549, as shown in FIG. 23.

System 500 also includes cooling material 525, 527, such as cold gel, which can be removably placed inside pocket 530 and/or pocket 532, respectively to cool and/or maintain cold the content of one or more beverage containers placed in the interior space 508.

In an exemplary implementation, container 502 can further comprise an integral handles 504, for example formed by shaping the single sheet of flexible plastic material forming container 502 to include a handle structure including an opening 507, to facilitate hand carry of container 502. In yet another exemplary implementation, the flexible plastic material forming container 502 allows collapsing of interior space 508 when not accommodating beverage containers, and collapsing of pockets 530, 532 when not accommodating cooling material, such that container 502 becomes essentially flat when not in use. In yet further exemplary implementation, exterior surface of wall structure 526 can be modified, for example by painting, to include any design 590 thereon.

While the invention has been shown and described with reference to a certain exemplary embodiment thereof, it will be understood by those skilled in the art that various changes in form and details may be made therein without departing from the spirit and scope of the invention as defined by the appended representative claims and the full scope of equivalents thereof.

I claim:

1. A container comprising: an exterior wall structure formed from a single sheet of flexible material folded to form a base and sealed along opposite sides of said single sheet to define an interior space within said exterior wall structure for accommodating one or more beverage containers in said interior space;

a handle structure attached to said exterior wall structure, said handle structure including an opening to facilitate hand carry of said container; and at least one interior pocket formed by an interior wall attached to a portion of an interior surface of said exterior wall structure, wherein said exterior wall structure formed from said single sheet of said flexible material is configured to collapse said interior space when not accommodating said one or more beverage containers, and collapse said at least one interior pocket, such that said container becomes collapsed.

2. A portable cooling system comprising: a container including an exterior wall structure formed from a single sheet of flexible material folded to form a base and sealed along opposite sides of said single sheet to define an interior space within said exterior wall structure for accommodating one or more beverage containers in said interior space, a first handle structure attached to said exterior wall structure, said first handle structure including a first opening to facilitate hand carry of said container, and a first interior pocket formed by a first interior wall attached to a first portion of an interior surface of said exterior wall structure; and a cooling material removably placed inside said first interior pocket to at least one cool and maintain cold a content of said one or more beverage containers placed in said interior space, wherein said exterior wall structure formed from said single sheet of said flexible material is configured to collapse said interior space when not accommodating said one or more beverage containers, and collapse said at first interior pocket when not accommodating said cooling material, such that said container becomes collapsed.

3. The portable cooling system of claim 2, further comprising a second interior pocket formed by a second interior wall attached to a second portion of said interior surface of said exterior wall structure.

4. The portable cooling system of claim 3, wherein said second portion of said interior surface of said exterior wall structure is opposite said first portion of said interior surface of said exterior wall structure.

5. The container of claim 1, wherein said handle structure is integrally formed with said exterior wall structure.

6. The portable cooling system of claim 2, wherein said first handle structure is integrally formed with said exterior wall structure.

7. The portable cooling system of claim 2, wherein said first handle structure is attached to said exterior wall structure at a first top portion of said exterior wall structure, and said container further includes a second handle structure is attached to said exterior wall structure at a second top portion of said exterior wall structure, said second handle including a second opening to facilitate hand carry of said container.

8. The portable cooling system of claim 7, wherein at least one of said first handle structure and said second handle structure is integrally formed with said exterior wall structure.

9. The portable cooling system of claim 7, wherein said first handle structure and said second handle structure are integrally formed with said exterior wall structure.

* * * * *